US006800951B2

(12) United States Patent
Jefferson

(10) Patent No.: US 6,800,951 B2
(45) Date of Patent: Oct. 5, 2004

(54) OBRIN POWER SYSTEM

(75) Inventor: Obrin Jefferson, 2601 Fremont St. #83, Bakersfield, CA (US) 93304

(73) Assignee: Obrin Jefferson, Bakersfield, CA (US)

( * ) Notice: Subject to any disclaimer, the term of this patent is extended or adjusted under 35 U.S.C. 154(b) by 103 days.

(21) Appl. No.: 10/287,045

(22) Filed: Nov. 4, 2002

(65) Prior Publication Data

US 2004/0084904 A1 May 6, 2004

(51) Int. Cl.[7] ..... H02P 9/04

(52) U.S. Cl. ..... 290/1 R; 165/DIG. 9; 60/643; 290/1 A

(58) Field of Search ..... 290/1 R, 1 A, 290/2, 4 R; 165/DIG. 9; 60/643

(56) References Cited

U.S. PATENT DOCUMENTS

| | | | | | |
|---|---|---|---|---|---|
| 3,845,627 | A | * | 11/1974 | Hutchinson | 60/641.3 |
| 4,443,707 | A | * | 4/1984 | Scieri et al. | 290/4 R |
| 4,540,501 | A | * | 9/1985 | Ternes et al. | 252/70 |
| 4,676,225 | A | * | 6/1987 | Bartera | 126/636 |
| 5,333,677 | A | * | 8/1994 | Molivadas | 165/272 |
| 6,330,909 | B1 | * | 12/2001 | Takahashi et al. | 165/202 |

* cited by examiner

*Primary Examiner*—Nicholas Ponomarenko

(57) ABSTRACT

The invention relates to a method and apparatus for formulating energy lag time technology by converting multiple energy sources to assemble a generator power supply system with an optional multi zone HVAC/R add-on. An electric starter motor that mechanically turns a generator or alternator that produces the amount of electric energy needed to be transformed into heat (thermal) energy, wherein this heat energy is absorbed by a liquid fluid. Heat energy converting the liquid fluid into a super heated high pressure energy vapor. This super heated pressure energy is then transformed into mechanical energy by means of a rotary turbine. The turbines' mechanical energy is used to turn the generator or alternator producing an electric energy source. The electric energy at this point will have means for stepping up the voltage to a higher output of electric energy needed for operating other electrical and/or electronic devices and applications apart from the system. Part of the higher electric energy output is also directed back into the system where the lower amount of electric energy is needed to cause the heat energy. An expansion chamber in the system superheats the fluid to a vapor state which is then transferred to a primary condenser by its own pressure. This vapor is used by the turbine at a lower pressure and slower rate then it was prepared at the expansion chamber. This difference in pressure being used at the turbine creates an energy lag time thereby causing the high pressurized vapor in the primary condenser to act as a energy storage container or fuel tank. After the systems primary condenser reaches a desired high pressure point, the starter will cut off temporarily and the generator and/or alternator will be turned by the fluid pressure driven turbine. This forms a charge of energy that will aid the electric generator power supply system to be more energy efficient. It can be used as a sole source of power or part of a unit or application.

5 Claims, 3 Drawing Sheets

Top View

Side View

OBRIN POWER SYSTEM

BACKGROUND OF THE INVENTION

Figure 1:
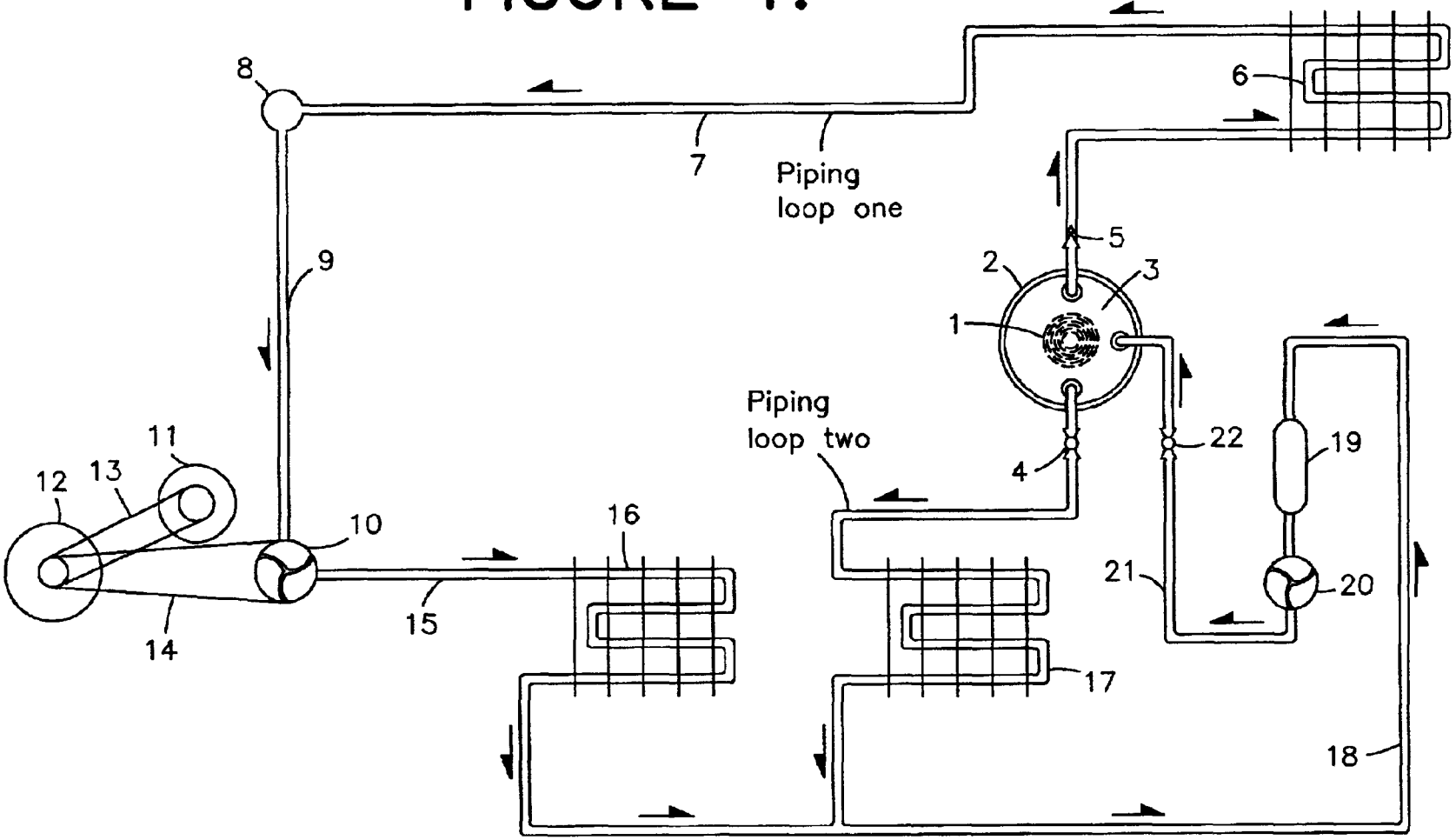

The present day forms of creating clean non-polluting electric energy are solar power and wind power. These two sources of power are clean and have an abundant supply. But, the drawback in these power sources is that they are unpredictable due to weather conditions. Also determining the correct geographic location is crucial for achieving optimal performance, this may not be obtainable in many environments or circumstances. However, the main advantage of these two power supply systems is their ability to operate on free energy sources with relatively low maintenance cost for up keep.

The current batteries of today with their higher storage capacity assist both solar and wind powered energy supply systems to overcome unforeseeable weather conditions. With the aid of energy stored in batteries gives solar and wind powered electric generators the ability to deliver a continual source of on going power helping to overcome the hurdle of weather inconsistences. Nevertheless, most people do not have the space nor funds to utilize one of these type of systems for generating their own electric power due to the expanse in which large areas are required for a structural setup. This problem also causes them to lack movement in many instances where mobility is needed.

Other attempts have been made to create power without generating pollutants such as the Sterling engine, but this apparatus lacks feasibility and has extensive limitations. There have also been attempts to utilize the method of converting thermal energy into mechanical energy, but the disadvantage with these and other apparatuses of this type is that they are not regenerative and commonly depend on fossil fuels.

BRIEF SUMMARY OF THE INVENTION

The present invention relates to a new method and apparatus for converting multiple energy sources into a useable and functional power aiding electric generator power supply system while applying energy lag time technology.

An environmentally clean power supply unit is needed that can produce electric energy while utilizing a very small space. The Obrin power system can be used in a practical way without being bulky or cumbersome. The Obrin power system will provide both mobile and/or stationary capabilities in a smaller packaged unit.

The compact size of the Obrin power system with energy lag time (ELT) technology makes it a very effective and beneficial addition to a electric power supply unit that can have a wide variety of uses in many applications and/or devises.

Energy lag time is the utilization of the gap in time before full energy depletion takes place at a predetermined location in the system. This gap in time being created by both slow dissipating and fast depleting energies which are manifested within the unit enables the power supply system to prolong energy output depletion, thereby producing a more energy efficient electric generating power supply which is the Obrin power system. A more detailed explanation on this subject in the technical field section.

TECHNICAL FIELD

Method of Energy Lag Time (ELT) Explained

1. The ability to temporarily change or switch the systems' energy start point thereby achieving a lengthened period of energy output from a power supply. 2. Creating a delay in time before full energy depletion takes place at a predetermined point in the system. 3. Utilizing the delay in time created before full energy depletion takes place at the predetermined point in the system, so that at a different planned location additional energy is being accumulated by the system, thereby providing the means for the prolonging of energy depletion state by conserving power while empower other devices and/or applications.

Energy lag time technology will provide a aid to a power source. In this power supply unit, before energy lag time, the systems start point will occur at the electric energy producing device where it will provide the electric energy output required for the start-up operation. See below for energy conversion sequence;

System sequence before energy lag time (ELT), during start-up mode

1. Electric energy (original starting point)
2. Heat energy (thermal dynamic energy)
3. Pressure force
4. Mechanical energy
5. Electric energy (back to the original starting point)

System sequence operating in energy lag time (ELT), now in run mode

1. Pressure force (becomes new starting point)
2. Mechanical energy
3. Electric energy
4. Heat energy (thermal dynamic energy)
5. Pressure force (back to the said new starting point)

The energy conversion sequence is not limited to the order in which it is presented and listed above, energy conversions can be arranged in any number of configurations to provide energy lag time results. The list above is one example arrangement of energy transformation.

Energies dissipate their potential at different rates in time and in speed, therefore electric current from a generator can deplete its power very quickly in comparison to a liquid that can store heat energy (thermal dynamic) for longer periods. Depending on what mediums are used to store this heat energy and the release rate at which this heat energy will be depleted from the medium, also the mechanical device being utilized and how efficiently it can operate will determine the performance of the overall Obrin power system.

Liquid refrigerant has the ability to become superheated at a low temperature and then transform into a very high pressurized vapor, this greatly controls the amount of energy lag time a system can maintain. When the high pressurized vapor is being utilized by a rotary turbine at a slower rate and lower pressure then it is generated at the expansion chamber produces a difference in pressure. This difference in pressure creates an energy lag time making the primary condenser function as a reservoir or storage tank filled with a high pressurized vapor containing energy potential.

An example of this technology shows that if a turbine is utilizing the high pressurized refrigerant vapor accumulated in the primary condenser at a rate of less than 90 pounds per square inch (rotary turbine operating at 90 psi maximum), whereas the minimum operating pressure that will be predetermined of no less than 200 pounds per square inch at the primary condenser (a minimum operating pressure of 200 psi at the primary condenser) will create a delay in the time that it will take before the high pressure and thermal energy accrued in the primary condenser to fully deplete.

By utilizing this interval or gap in time, before full energy depletion can occur at the primary condenser creates a window of opportunity for the Obrin power system to generate the additional electric energy needed to assist and replenish the primary condenser with superheated pressurized vapor. By keeping the primary condenser at optimal pressure conditions enables the Obrin power system to help support the systems' operation.

Also, this same additional electric energy will be increased to a higher voltage output by means of a step-up transformer or the like, so that the electric generator power supply system will have extra electric energy to support and provide for other devices and/or applications outside of the system Obrin power system.

It is understood that a prolonged energy depletion rate at the primary condenser by use of an efficient rotary turbine will provide more energy lag time thereby achieving a system operating with a greater rate in performance. By using various arrangements of devices, fluids and materials will allow for different combinations that can formulate differing times in energy depletion rates which will determine the performance of the Obrin power system. Note that the system will have means for cycling itself automatically.

When the expandable fluid in the system is superheated to a vaporized state and reaches the desired high pressure point needed for aiding system operation of the Obrin power system, the electric starter motor powered by means of a on board direct current (DC) battery source or an alternating current (AC) source from an outside or remote location will cut off and the high pressurized vapor from the primary condenser will extend the systems' operation and also temporarily become the units' new energy starting point. While system is in energy lag time state battery or AC source will be temporarily suspended until needed.

A halt in the flow of expandable refrigerant fluid just before the rotary turbine machine will stop the mechanical process and/or a break in the electric energy supplied to the direct superheating element at the expansion chamber will perform a result in shutting down or powering down the Obrin power system.

By increasing the electric energy output to a higher voltage output with the use of a transformer or the like will give the Obrin power system the ability to provide electric energy which can be utilized by a multiple of electrically operated devices and/or applications externally of the system. A portion of this higher voltage output will be use to power the expansion chamber, pump and other devices within the power supply system as needed within the interval generated by energy lag time technology.

While the present invention has been illustrated with reference to particular embodiments thereof, it will be understood that various modifications can be made by those skilled in the art without actually deviating from the scope of the invention. Therefore, all modifications and equivalents may be resorted to which fall within the scope of the invention as claimed.

DETAILED DESCRIPTION OF THE INVENTION

Title of the Invention: Obrin Power System

This invention will now be described in more detail referring to attached drawings. Note that all arrows depicted in drawings show the direction of fluid flow.

FIG. 1 shows the embodiment of the invention. The starting point is at the electric starter motor 11 which drives the electric energy producing device 12 by means of a rotational energy connecting element 13. The starter motor 11 will have enough torque to get the system up and running so that the fluid driven rotary machine 10 will not have to start under load conditions.

The electric energy producing device 12 will provide the electric energy that will be used to power the direct superheating element 1, fluid transferring device 20 and automatic valves 4 and 22.

The automatic valves 4 and 22 are normally in the close position and will open to allow expandable fluid 3 pumped from the receiver 19 by means of the fluid transferring device 20 to enter the expansion chamber 2. Super heating the expandable fluid 3 will take place by means of the direct superheating element 1. Most of these items are electrically powered devices.

The electric energy means to energize these devices will be provided by the start up operation of the starter motor 11, rotational energy connecting element 13 and the electric energy producing device 12. The electric power provided to the starter motor 11 will come from an alternating current (AC) outside power source and/or a on board direct current (DC) battery power source.

Once the expansion chamber 2 is filled to the desired level with expandable fluid 3, the fluid transferring device 20 will stop pumping expandable fluid 3 and the automatic valves 4 and 22 will close back to their normally close position trapping the expandable fluid 3 inside a gas tight hermetic casing (called the expansion chamber 2).

The liquid expandable fluid 3 is now prepared to be superheated to a high pressure vapor induce by the direct superheating element 1. Once the expandable fluid 3 is superheated to a vapor state, the force from this pressurized vapor will cause the expandable fluid 3 to expand and evacuate the expansion chamber 2 by way of an outlet tubing connected to a check valve 5.

The check valve 5 is used to allow fluids to flow in only one direction so that the fluid moves forward and prevents it from reversing or backing up.

All the liquid expandable fluid 3 inside the expansion chamber 2 will be boiled or expanded to a complete vapor state. The expandable fluid 3 now leaving the expansion chamber 2 has now changed from a low pressure liquid into a high pressurized vapor and will advance itself inside the tubing and arrive at the primary condenser 6.

The high pressurized expandable fluid 3 in the primary condenser 6 will travel down stream by means of tubing 7 and will decelerated by means of a adjustable pressure regulator 8.

The function of the adjustable pressure regulator 8 will be to allow a desired amount of expandable fluid 3 flow, by reducing the pressure and flow creates a controlling means for the amount of energy available to be used by the rotary machine 10. The high pressurized expandable fluid 3 within tubing 7 will be decreased at the point of the adjustable pressure regulator 8 so that it will now be at a considerably lower pressure within the tubing 9.

The expandable fluid 3 now adjusted and calibrated to a lower pressure inside tubing 9 will flow down stream to provide the energy needed to propel the rotary machine 10, thereby causing the rotary machine 10 to rotate at the proper speed and force required to mechanically turn the electric energy producing device 12 by means of a rotational energy connecting element 14.

As stated in the technical field section entitled Method of Energy Lag Time explained: clarifies this principle which applies to the components that will produce this technology. The turbine being a rotary machine 10 will operate on a limited amount of the high pressure expandable fluid 3 within the primary condenser 6. This will permit the energy lag time allowing for a slower rate of energy depletion within the primary condenser 6. This effect will cause the primary condenser 6 to have a surplus of energy to be utilized by the system, thereby making it temporarily become the systems' new energy start point.

The expandable fluid 3 upon entering and leaving the rotary machine 10 producing the mechanical energy needed to turn the electric energy producing device 12 will travel down stream by means of tubing 15 where it will enter the secondary condenser 16.

The expandable fluid 3 will now be under even lower pressure conditions inside the secondary condenser 16 so that the expandable fluid 3 may condense back into a liquid state for system reuse. Once the expandable fluid 3 condenses into a liquid, it will travel down stream by means of tubing 18 and be stored in the receiver 19 so that the liquid expandable fluid 3 will be ready for reuse by the fluid transferring device 20.

This is what's known as piping loop one, the loop providing the energy needed to help operate the Obrin power system and provide power for other devices and applications.

The purpose of the piping loop two is to provide both pressure relief of the expansion chamber 2 and to reduce the load against the fluid transferring device 20 throughout the filling and refilling cycle.

As both automatic valves 4 and 22 open, automatic valve 4 will allow the remaining vapor inside the expansion chamber 2 to escape and enter the recycling condenser 17 so that the expandable fluid 3 in its vapor state can be condensed back into a liquid for reuse. It to will travel by means of tubing 18 and be stored inside the receiver 19 so that it will be ready for system reuse.

This ends the detail description for FIG. 1.

Figure 2:
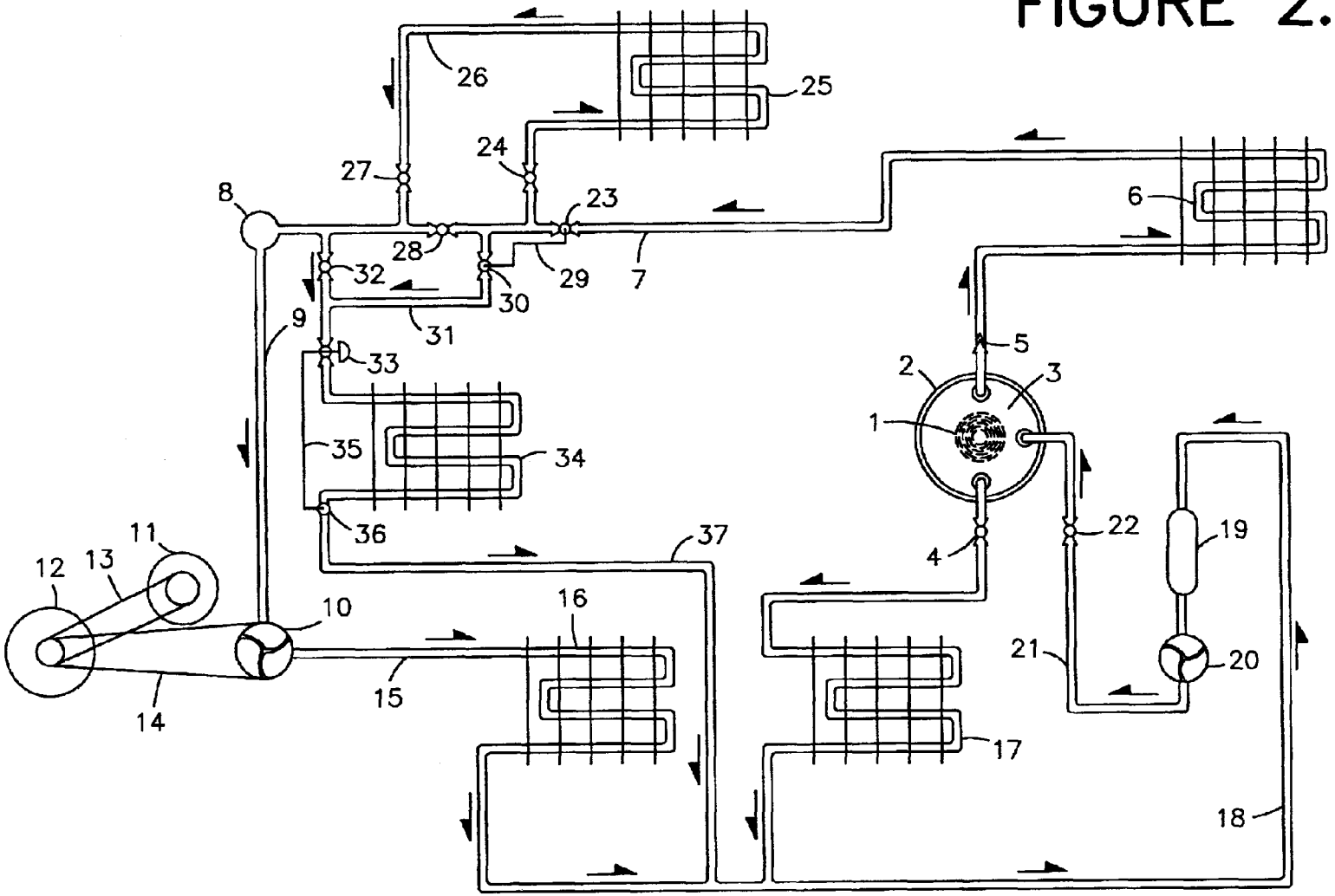

FIG. 2 shows all the same components of FIG. 1, but with the addition of the heating, ventilation and air conditioning or refrigeration add-on to produce a stand-alone climate control system.

The starting numbers are the same from 1 through 22 of FIG. 1, FIG. 2 has the addition of 23 through 37. The system operates in the same fashion but with an add on.

Heating Cycle of the Unit

Automatic valves 24 and 27 are normally in the closed position until the heating cycle is requested. The automatic valves 24 and 27 will open to allow expandable fluid 3 to travel by means of tubing 7. The superheated expandable fluid 3 will have a high heat content when entering the heating coil (heat exchanger) 25 by way of automatic valve 24 now in the open position.

The expandable fluid 3 upon leaving the heating coil 25 will travel by means of tubing 26 entering automatic valve 27 still in the open position where the expandable fluid 3 will now enter the adjustable pressure regulator 8.

During this operation the automatic valve 28 which is normally in the open position for expandable fluid 3 flow will close so that all the superheated expandable fluid 3 leaving the primary condenser 6 traveling by way of tubing 7 will enter the heating coil 25.

Cooling Cycle of the Unit

When the air condition is called upon for cooling, automatic valve 32 will open to permit superheated expandable fluid 3 to flow forward to the thermal expansion valve (TXV) 33 and then enter the cooling coil (heat exchanger) 34.

The temperature sensing element 36 is connected to the tubing just after the cooling coil 34. The connection link 35 is part of the thermal expansion valve (TXV) that detects the temperature of the expandable fluid 3 leaving the cooling coil 34.

The expandable fluid 3 after leaving the cooling coil 34 and flowing past the sensing element 36 will now travel down stream into tubing 37 and proceed to tubing 18 until it approaches the receiver 19 so that it will be ready for system reuse.

Note: Both heating and cooling cycles do not operate at the same time.

The high pressure sensing element 23 is a safety device for detecting extreme pressures. The automatic valve 30 is normally closed and will open if extreme pressure is detected at the sensing element 23. The connection 29 links the sensing element 23 to the automatic valve 30 which will allow tubing 31 to act as a bypass to prevent the system from being over pressurized.

This ends the detail description for FIG. 2.

Figure 4:
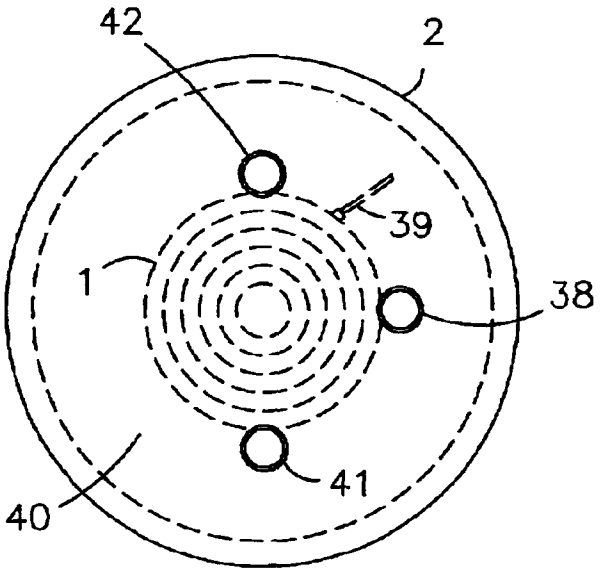
Figure 3:
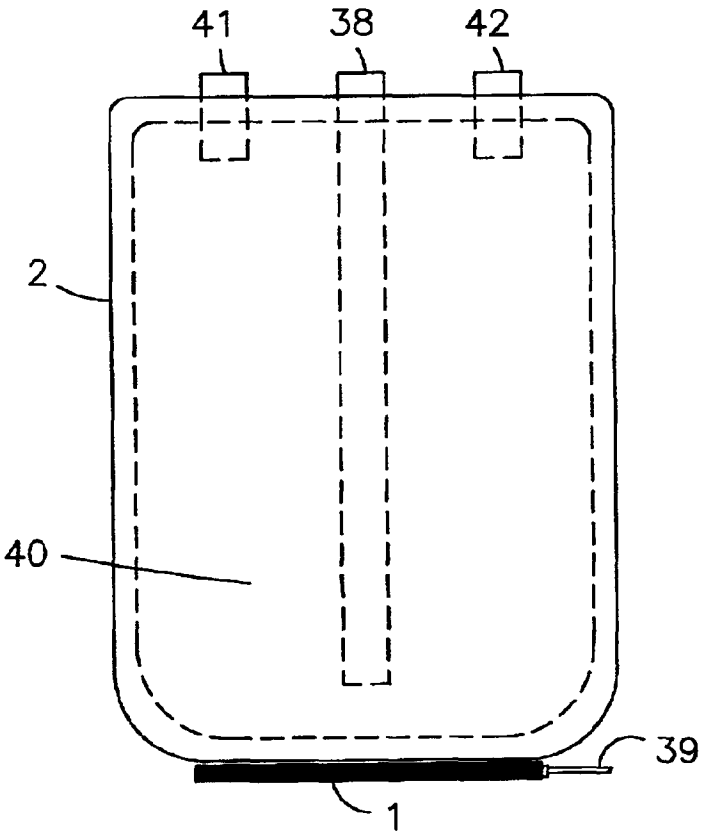

Note: FIG. 3 and FIG. 4 illustrate the expansion chamber 2 in more detail, also note that the expandable fluid 3 in FIG. 1 and FIG. 2 refers to the fluid used by the system and that in FIG. 3 and FIG. 4 the internal housing 40 refers to the hermetic inside casing compartment of the expansion chamber 2.

FIG. 3 illustrates the side view of the expansion chamber 2 while FIG. 4 illustrates the top view of the expansion chamber 2. The expansion chamber 2 contains a hollowed internal housing 40 built to withstand high pressure and high temperatures from the superheated expandable refrigerant fluid or the like.

The expansion chamber 2 has three tubing connections total, two tubing outlets and one tubing inlet. The outlet tubing 41 is the relief outlet used for extracting the remaining high pressure vapor from the internal housing 40 of the expansion chamber 2 during the filling and refilling cycle so that the unused vapor can be condensed and recycled for reuse. The outlet tubing 42 is the vapor discharge outlet used for releasing the usable superheated vapor into the system for use of its high pressure and thermal energy. The one inlet tubing 38 is used for filling and refilling means.

The one inlet tubing 38 provides access for the liquid refrigerant or the like to enter the internal housing 40 of the expansion chamber 2.

The direct superheating element 1 is utilized to swell or expand the refrigerant or the like and cause it to go from a liquid state to a superheated vapor state inside the internal housing 40 of the expansion chamber 2.

The direct superheating element 1 is an electrically powered device.

The connection 39 is a connecting means for allowing electric energy to flow to the direct superheating element 1. The internal housing 40 is where the expansion of the liquid refrigerant will take place. The expansion chambers' 2 internal housing 40 is a leak free hermetically sealed container.

This ends the detail description for FIG. 3 and FIG. 4.

I claim:

1. An energy supply system with ability to accumulate energy for later utilization comprising:

(a) a first fluid circulation loop with a conduit, a pressure regulator, a turbine-pump, a set of condensers, a first valve, a second valve;

(b) a second fluid circulation loop with a conduit, a pump, a third valve;

(c) an expansion chamber to which the first and the second circulation loops are connected;

(d) a working fluid with ability to change its operational states from a liquid to superheating gas in the boundary of the system and ability to circulate through the first and the second loops;

(e) a superheating element for bringing said working fluid into superheating state in the expansion chamber;

(f) an electrical generator driven by the turbine-pump;

(g) an electrical motor for driving said turbine-pump;

(h) wherein said electric motor accumulates energy in the first circulation loop by driving said turbine-pump and increasing pressure of the working fluid;

(i) wherein said accumulated energy is utilized with a lag of time by releasing said working fluid pressure by the second valve and the pressure regulator for circulation in the first loop and for driving said turbine-pump as a turbine, which in turn drives said generator for production of an electrical power.

2. An energy supply system according to claim 1, wherein the second circulation loop is an auxiliary to the first circulation loop and provides condensing of the superheated working fluid within the system, its storage and utilization, as required.

3. An energy supply system according to claim 1, wherein operational stages of energy accumulations and energy releases with associated starting of the motor, opening valves, supplying power to the superheating element, connecting or disconnecting the generator to the network are performed by a control scheme.

4. An energy supply system according to claim 3, wherein said control scheme is sensing changes in temperature and pressure of the working fluid.

5. An energy supply system according to claim 1, wherein the set of condensers consists of a primary condenser, a secondary condenser and a recycling condensing stage.

* * * * *